US007588875B2

(12) United States Patent
Hu et al.

(10) Patent No.: US 7,588,875 B2
(45) Date of Patent: Sep. 15, 2009

(54) EXTERNAL SURFACE ADDITIVE COMPOSITIONS

(75) Inventors: Nan-Xing Hu, Oakville (CA); Cuong Vong, Hamilton (CA); John F. Graham, Oakville (CA); Richard P. N. Veregin, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/202,794

(22) Filed: Sep. 2, 2008

(65) Prior Publication Data

US 2008/0318145 A1 Dec. 25, 2008

Related U.S. Application Data

(62) Division of application No. 11/198,283, filed on Aug. 8, 2005, now Pat. No. 7,452,646.

(51) Int. Cl.
*G03G 13/08* (2006.01)

(52) U.S. Cl. ..... 430/123.51; 430/123.41; 430/123.5; 399/159

(58) Field of Classification Search ..... 430/123.41, 430/123.5, 123.51; 399/159
See application file for complete search history.

(56) References Cited

U.S. PATENT DOCUMENTS

| | | | |
|---|---|---|---|
| 3,590,000 | A | 6/1971 | Palermiti et al. |
| 4,356,291 | A | 10/1982 | Darling |
| 4,558,108 | A | 12/1985 | Alexandru et al. |
| 4,853,311 | A | 8/1989 | Tavernier et al. |
| 5,227,460 | A | 7/1993 | Mahabadi et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,364,729 | A | 11/1994 | Kmiecik-Lawrynowicz et al. |
| 5,368,967 | A | 11/1994 | Schank et al. |
| 5,370,963 | A | 12/1994 | Patel et al. |
| 5,403,693 | A | 4/1995 | Patel et al. |
| 5,418,108 | A | 5/1995 | Kmiecik-Lawrynowicz et al. |
| 5,510,220 | A | 4/1996 | Nash et al. |
| 5,534,379 | A | 7/1996 | Dalal et al. |
| 5,536,614 | A | 7/1996 | Kondo et al. |
| 5,593,807 | A | 1/1997 | Sacripante et al. |
| 5,618,647 | A | 4/1997 | Kukimoto et al. |
| 5,681,679 | A | 10/1997 | Schank et al. |
| 6,177,221 | B1 | 1/2001 | Maniar et al. |
| 6,319,647 | B1 | 11/2001 | Gutman et al. |
| 6,365,316 | B1 | 4/2002 | Stamp et al. |
| 6,416,916 | B1 | 7/2002 | Silence et al. |
| 6,692,880 | B2 | 2/2004 | Fields et al. |
| 6,797,448 | B2 | 9/2004 | Fields et al. |
| 2003/0162119 | A1 | 8/2003 | Vanbesien et al. |
| 2004/0062568 | A1 * | 4/2004 | Nukada et al. ..... 399/159 |
| 2004/0086794 | A1 | 5/2004 | Yamada et al. |
| 2004/0137352 | A1 | 7/2004 | McStravick et al. |
| 2005/0042535 | A1 | 2/2005 | Vanbesien et al. |

FOREIGN PATENT DOCUMENTS

| | | |
|---|---|---|
| JP | 35-7130048 | 8/1982 |

OTHER PUBLICATIONS

U.S. Appl. No. 11/034,062, filed Jan. 13, 2005, Qi et al.
U.S. Appl. No. 10/998,585, filed Nov. 30, 2004, Bender et al.
DuPont Krtyox Performance Lubricants Product Overview, copyright 2002.

* cited by examiner

*Primary Examiner*—Mark F Huff
*Assistant Examiner*—Peter L Vajda
(74) *Attorney, Agent, or Firm*—Oliff & Berridge, PLC

(57) ABSTRACT

A toner having at least one binder, at least one colorant and external additives. The external additives include at least one fluoropolymer. An electrophotographic image forming machine and method includes the toner with at least one fluoropolymer.

20 Claims, No Drawings

EXTERNAL SURFACE ADDITIVE COMPOSITIONS

This is a Division of Application No. 11/198,283 filed Aug. 8, 2005, now U.S. Pat. No. 7,452,646. The entire disclosure of the prior application is hereby incorporated by reference herein in its entirety.

BACKGROUND

This disclosure relates to toner and a method of forming images utilizing electrophotographic photoreceptors. More in particular, the disclosure relates to toner having specific external additives in order to improve the performance characteristics of electrophotographic photoreceptors. Specifically, the rotational torque is reduced while the amount of deletion in the developed image is decreased.

Electrophotographic method has been generally used when an image is formed in copier or a laser beam printer. In conventional electrophotographic image forming methods, an image is formed by developing an electrostatic latent image formed on a photoreceptor with a toner developer. The electrostatic latent image is then transferred to an image receiving member such as recording paper. Next, the electrostatic image is fixed to the image receiving member using heat and pressure.

Methods for developing the electrostatic latent image include a one-component developing method, which uses only a toner. Also known is a two-component developing method, which uses a toner and a carrier. In the case of the two-component developing method, the toner and the carrier are stirred to triboelectrically charge the toner. Therefore, the amount of triboelectric charge of the toner can be controlled to a considerable extent by selecting carrier characteristics and stirring conditions.

The toners conventionally used in the electrophotographic process may be produced by various methods. For example, toners may be produced by adding various resins (e.g., polyester resin, styrene-acryl resin, and epoxy resin), colorants, charge control agents, releasing agents and the like, and then melting, kneading, and uniformly dispersing the mixtures. This is followed by crushing the mixture into a predetermined grain size and removing excessively coarse powders and micropowders using a classifier. Toners may also conventionally be produced by chemical methods, such as by the suspension polymerization method, and an emulsion polymerization coagulation method.

U.S. Pat. No. 6,319,647 discloses a toner including toner particles containing at least one binder, at least one colorant, and preferably one or more external additives. The toner is advantageously formed into a developer and used in a magnetic brush development system to achieve consistent, high quality copy images. The toner particles, following triboelectric contact with carrier particles, exhibit a charge per particle diameter (Q/D) of from 0.6 to 0.9 fC/μm and a triboelectric charge of from 20 to 25 μC/g. The toner particles preferably have an average particle diameter of from 7.8 to 8.3 microns. The toner is combined with carrier particles to achieve a developer, the carrier particles preferably having an average diameter of from 45 to 55 microns and including a core of ferrite substantially free of copper and zinc coated with a coating comprising a polyvinylidenefluoride polymer or copolymer and a polymethyl methacrylate polymer or copolymer. In this developer, the fluoropolymer is on the carrier coating.

U.S. Pat. No. 6,416,916 discloses a toner made of toner particles containing at least one binder, at least one colorant, and an external additive package comprised of zinc stearate and at least one of silicon dioxide or titanium dioxide, wherein the amount of zinc stearate is limited to about 0.10 percent by weight or less of the toner. It is reported that when the amount of zinc stearate is limited, a developer formed from the toner exhibits excellent triboelectric charging, stability and developer flow.

U.S. Pat. Nos. 6,797,448 and 6,692,880 disclose a development system for toner that includes a toner having at least one toner resin, at least one release agent, at least one surface treatment, and optionally at least one charge control agent or colorant or both. The surface treatment, also known as spacer particles, includes acrylic polymer, silicone-based polymer, styrenic polymer, fluoropolymer, or mixtures thereof.

The photoreceptor used in electrophotography may comprise a single layer configuration or a multi-layered structure. For example, an electrophotographic photoreceptors having dual layer structure comprises two layers consisting of a charge generation layer and a charge transport layer. Since the photoreceptor is used repeatedly, a cleaning device is typically disposed to remove residual toner left on the photoreceptor after the transfer. In the aforementioned image forming method, the characteristics of the photoreceptor are adversely affected due to various causes, such as surface deterioration caused by charging device, wear due to abrasion, reduced sensitivity and reduced charging ability caused by the electrical impact of discharging at the photoreceptor surface, and mechanical breakdown resulting from friction during subsequent toner development, transfer to paper, and cleaning. In order to improve the durability of the photoreceptor, a protective overcoat with a highly crosslinked polymer composition is applied. The overcoat layer had overwhelmingly superior chemical stability and mechanical strength with respect to conventional surface layers, whereby deterioration of the surface layer caused by wear can be significantly reduced and longevity can be improved.

U.S. Pat. No. 5,681,679 discloses a flexible electrophotographic imaging member including a supporting substrate and a resilient combination of at least one photoconductive layer and an overcoat layer. The photoconductive layer includes a hole transporting arylamine siloxane polymer and the overcoat includes a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 5,368,967 discloses an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials including Elvamide polyamide and N,N'-diphenyl-N,N'-bis(3-hydroxyphenyl)-[1,1'-biphenyl]-4,4'-diamine and bis-[2-methyl-4-(N-2-hydroxyethyl-N-ethyl-aminophenyl)]-phenylmethane are disclosed in this patent.

Silicon overcoat layers ("SOC"), as disclosed in co-pending U.S. patent application Ser. No. 11/034,062, and incorporated herein by reference in its entirety, have demonstrated good potential for the life extension of photoreceptors. Owing to its crosslinked siloxane structure, SOC offers excellent abrasive, scratching and marring resistance. The SOC is typically prepared by curing a sol-gel type coating solution comprising a silane-containing hole transport molecule and an organic silane matrix binder.

While the photoreceptor having a SOC protective layer provides initial satisfactory image quality, its image quality deteriorates after repeated printing. It has been theorized that this deterioration occurs because the surface of a photoreceptor with low abrasion resistance possesses high coefficient of friction when the surface of the photoreceptor is cleaned with a rubber blade in a cleaning step, such as a urethane blade. This leads to blade damage and image defects.

Furthermore, when the siloxane surface layer is used for a long period of time, especially in a humid environment, image defects, such as image deletion, are caused.

It is theorized that after exposure to charging for a long period of time in a humid environment, the SOC surface of the photoreceptor becomes hydrophilic as the siloxane surface is denatured by the action of the ozone and NOx generated during the charging process. The deteriorated surface tends to adsorb moisture in the atmosphere, causing the electrical resistance of the surface to be microscopically reduced and difficulty in maintaining the electrostatic latent image.

Thus, it is still desired to improve the durability of the photoreceptor by providing an improved toner additive, an improved image forming method and an improved image forming apparatus.

SUMMARY

In a first embodiment, a toner is described that comprises toner particles of at least one binder, at least one colorant and external additives. The external additives include a waxy fluoropolymer or an oily fluoropolymer.

In another embodiment, described is an electrophotographic image forming apparatus that comprises a photoreceptor having a silicon overcoat, a latent image forming device, a developing device, a transfer device, and toner developing agent in the developing device having the fluoropolymer external additive compounds.

In embodiments, described is an electrophotographic image forming method comprising developing an electrostatic image with a toner developer agent to develop a toner image and fixing the transferred image to an image receiving member. The electrostatic image in embodiments is formed on a photoreceptor having a silicon overcoat layer and the toner developer agent includes toner particles with a fluoropolymer external additive.

DETAILED DESCRIPTION OF EMBODIMENTS

The image forming method disclosed herein comprises developing an electrostatic latent image formed on the surface of a photoreceptor by using a developing agent to form a toner image, transferring the toner image to an image receiving member to form a transferred image and fixing the transferred image to the image receiving member, for example, an intermediate transfer member or a print substrate, such as paper, to form an image. The photoreceptor includes at least a silicon overcoat comprised of a crosslinked polysiloxane composition having charge-transferability. The developing agent, i.e., toner, includes a fluorinated polymer as an external additive. This external additive is deposited on the surface of the photoreceptor.

This image forming process can be repeated as many times as necessary with a reusable photoreceptor. To this end, a cleaning device is typically disposed to remove residual toner left on the photoreceptor.

In embodiments, an electrophotographic image forming apparatus includes a photoreceptor, a latent image forming device for forming an electrostatic latent image on a surface of the photoreceptor, a developing device for developing the latent image using a toner developer agent. The toner includes toner particles of a binder and a colorant, at least a fluoropolymer additive, and a transfer device for transferring the toner image to an image receiving member. In embodiments, the photoreceptor includes at least a silicon overcoat layer comprised of a crosslinked polysiloxane composition having charge-transferability. The toner developer agent includes a fluoropolymer as an external additive which is deposited onto the surface of the photoreceptor.

Following transfer of the developed image, the photoreceptor may be cleaned of any residual developer remaining on the surface and of any residual electrostatic charge prior to being subjected to charging for development of further images.

Examples of photoreceptors having a silicon overcoat in embodiments that may be employed herein include, but are not limited to, those described in U.S. Publication No. 2004/0086794 A1, co-pending U.S. application Ser. No. 10/998,585, co-pending U.S. application Ser. No. 11/034,062 and co-pending U.S. application Ser. No. 11/179,943, each of which is incorporated herein by reference in its entirety.

In embodiments, the fluorinated polymer is added, as an external additive, to a developing agent/toner and the fluoropolymer is supplied together with the toner with dispersing it on the surface of the photoreceptor when the toner image is formed.

Without limiting this disclosure, it is surmised that a portion of the fluoropolymer additive encompassed in the toner is rubbed off in a thin layer on the photoconductive member. The thin layer of fluoropolymer formed on the photoconductive member may act as a lubricant and decrease the amount of friction between the photoconductive member and the cleaning blade of the electrophotographic image forming machine. Thus, the amount of damage to the photoconductive member or to the cleaning blade is reduced. Thereby, mechanical life of the electrophotographic image forming apparatus is increased.

Furthermore, by applying a thin layer of the fluorinated polymers on the surface of the photoreceptor through the imaging method described herein, the degradation of the surface of the photoconductive member may be suppressed. Thus, the photoconductive member is more resistant to environmental contaminants, thereby, maintaining its high electrophotographic image over a long period of time.

In embodiments, fluoropolymer external additives such as polytetrafluoroethylene (PTFE), poly(vinylidene fluoride), perfluoropolyethers, and the like are also present on the toners as external additives. These fluoropolymer additives may be provided in various forms, such as powder, wax and oils. Furthermore, addition of the fluorinated polymers as discussed herein does not adversely impact any desired properties of the toner.

The present disclosure is equally applicable to all toners/developers, to jetted toners, and to polyester emulsion/aggregation (EA) toners and styrene/acrylate EA toners.

Suitable and preferred materials for use in preparing toners herein will now be discussed.

Any resin binder suitable for use in toner may be employed without limitation. Further, toners prepared by chemical methods (emulsion/aggregation) and physical methods (grinding) may be equally employed. Specific suitable toner examples are as follows.

The toner can be a polyester toner particle which is known in the art. Polyester toner particles created by the emulsion/aggregation (EA) process are illustrated in a number of patents, such as U.S. Pat. No. 5,593,807, U.S. Pat. No. 5,290,654. U.S. Pat. No. 5,308,734, and U.S. Pat. No. 5,370,963, each of which are incorporated herein by reference in their entirety. The polyester may comprise any of the polyester materials described in the aforementioned references. As these references fully describe polyester EA toners and methods of making the same, further discussion on these points is omitted herein.

The toner can be a styrene/acrylate toner particle which is known in the art. Styrene/acrylate toner particles created by the EA process are illustrated in a number of patents, such as U.S. Pat. No. 5,278,020, U.S. Pat. No. 5,346,797, U.S. Pat. No. 5,344,738, U.S. Pat. No. 5,403,693, U.S. Pat. No. 5,418,108, and U.S. Pat. No. 5,364,729, each of which are incorporated herein by reference in their entirety. The styrene/acrylate may comprise any of the materials described in the aforementioned references. As these references fully describe styrene/acrylate EA toners and methods of making the same, further discussion on these points is omitted herein.

The toner can be generated by well known processes other than by EA process. For example, jetted toner particles are illustrated in a number of patents, such as U.S. Pat. No. 6,177,221, U.S. Pat. No. 6,319,647, U.S. Pat. No. 6,365,316, U.S. Pat. No. 6,416,916, U.S. Pat. No. 5,510,220, U.S. Pat. No. 5,227,460, U.S. Pat. No. 4,558,108, and U.S. Pat. No. 3,590,000, each of which are incorporated herein by reference in their entirety. The jetted toners comprise materials described in the aforementioned references. As these references fully describe jetted toners made by processes other than the EA process and methods of making the same, further discussion on these points is omitted herein.

Various known colorants, such as pigments, present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours and Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans that may be selected include copper tetra (octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, Yellow 180 and Permanent Yellow FGL, wherein the colorant is present, for example, in the amount of about 3 to about 15 weight percent of the toner. Organic dye examples include known suitable dyes, reference the Color Index, and a number of U.S. patents. Organic soluble dye examples, preferably of a high purity for the purpose of color gamut are Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, and more specifically, from about 5 to 20 weight percent of the toner. Colorants include pigment, dye, mixtures of pigment and dyes, mixtures of pigments, mixtures of dyes, and the like. This listing of colorants is for illustration only, any suitable colorant may be used herein. As understood by one of ordinary skill, pigments may be predispersed in a surfactant or resin binder to facilitate mixing.

Optionally, a wax can be present in an amount of from about 4 to about 12 percent by weight of the particles. Examples of waxes include polypropylenes and polyethylenes commercially available from Allied Chemical and Petrolite Corporation, wax emulsions available from Michaelman Inc. and the Daniels Products Company, EPOLENE N-15 commercially available from Eastman Chemical Products, Inc., VISCOL 550-P, a low weight average molecular weight polypropylene available from Sanyo Kasei K.K., POLYWAX® polyethylene waxes from Baker-Petrolite Company including POLYWAX 725, and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL 74, 89, 130, 537, and 538, all available from SC Johnson Wax, chlorinated polypropylenes and polyethylenes commercially available from Allied Chemical and Petrolite Corporation and SC Johnson Wax.

Optionally, the toner may also contain a high molecular weight binder component, such as a cross-linked gel, wherein the gel binder latex may be of particle size from 5 nm to 400 nm, and wherein the gel binder latex comprises from about 0% to about 50% of the total binder resin.

External additives are additives that associate with the surface of the toner particles. In embodiments, the external additives may optionally include at least one of silicon dioxide or silica ($SiO_2$), or titania or titanium dioxide ($TiO_2$). In general, silica is applied to the toner surface for toner flow, triboelectric enhancement, admix control, improved development and transfer stability and higher toner blocking temperature. $TiO_2$ is applied for improved relative humidity (RH) stability, triboelectric control and improved development and transfer stability. In a most preferred embodiment, the external additive package includes both silica and titania.

If employed, the $SiO_2$ and $TiO_2$ should preferably have a primary particle size of less than 200 nm. The silica preferably has a primary particle size in the range about 5 to about 200 nm. The titania preferably has a primary particle size in the range about 5 to about 50 nm. Of course, larger size particles may also be used, if desired, for example up to about 500 nm. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 50 to 200% surface area coverage (SAC). Another metric relating to the amount and size of the additives is "SAC×Size" ((percentage surface area coverage) times (the primary particle size of the additive in nanometers)), for which the additives should preferably have a total SAC×Size range between, for example, 1,000 to 4,000.

Surface treated silica that can be utilized include, for example, TS-530 from Cabosil Corporation, with an 8 nanometer particle size and a surface treatment of hexamethyldisilazane; NAX50, obtained from DeGussa/Nippon Aerosil Corporation, coated with HMDS; H2050EP, obtained from Wacker Chemie, coated with an amino functionalized organopolysiloxane; CAB-O-SIL® fumed silicas such as for example TG-709F, TG-308F, TG-810G, TG-811F, TG-822F, TG-824F, TG-826F, TG-828F or TG-829F with a surface area from 105 to 280 $m^2/g$ obtained from Cabot Corporation; PDMS-surface treated silicas as for example RY50, NY50, RY200, RY200S and R202, all available from Nippon Aerosil, and the like. Such surface treated silicas are applied to the toner surface for toner flow, triboelectric charge enhancement, admix control, improved development and transfer stability, and higher toner blocking temperature.

Surface treated titania materials that are suitable include, for example, metal oxides such as $TiO_2$, for example MT-3103 from Tayca Corp. with a 16 nanometer particle size and a surface treatment of decylsilane, SMT5103, obtained from Tayca Corporation, comprised of a crystalline titanium dioxide core MT500B coated with decyltrimethoxysilane (DTMS), P-25 from Degussa Chemicals with no surface treatment; an isobutyltrimethoxysilane (i-BTMS) treated hydrophobic titania obtained from Titan Kogyo Kabushiki Kaisha (IK Inabata America Corporation, New York), and the like. Such surface treated titania are applied to the toner surface for improved relative humidity (RH) stability, triboelectric charge control and improved development and transfer stability. The decyltrimethoxysilane (DTMS) treated titania is particularly preferred, in some embodiments.

Another preferred component of the additive package is a spacer particle. Spacer particles, particularly latex or polymer spacer particles, are described in, for example, U.S. Patent Application Publication No. 2004-0137352 A1, the entire disclosure of which is incorporated herein by reference.

In another preferred embodiment, the spacer particles are comprised of latex particles. Any suitable latex particles may be used without limitation. As examples, the latex particles may include rubber, acrylic, styrene acrylic, polyacrylic, fluoride, or polyester latexes. These latexes may be copolymers or crosslinked polymers. Specific examples include acrylic, styrene acrylic and fluoride latexes from Nippon Paint (e.g. FS-101, FS-102, FS-104, FS-201, FS-401, FS-451, FS-501, FS-701, MG-151 and MG-152) with particle diameters in the range from 45 to 550 nm, and glass transition temperatures in the range from 65° C. to 102° C. These latex particles may be derived by any conventional method in the art. Suitable polymerization methods may include, for example, emulsion polymerization, suspension polymerization and dispersion polymerization, each of which is well known to those versed in the art. Depending on the preparation method, the latex particles may have a very narrow size distribution or a broad size distribution. In the latter case, the latex particles prepared may be classified so that the latex particles obtained have the appropriate size to act as spacers as discussed above. Commercially available latex particles from Nippon Paint have very narrow size distributions and do not require post-processing classification (although such is not prohibited if desired).

In a further embodiment, the spacer particles may also comprise polymer particles. Any type of polymer may be used to form the spacer particles of this embodiment. For example, the polymer may be polymethyl methacrylate (PMMA), e.g., 150 nm MP1451 or 300 nm MP116 from Soken Chemical Engineering Co., Ltd. with molecular weights between 500 and 1500K and a glass transition temperature onset at 120° C., fluorinated PMMA, KYNAR® (polyvinylidene fluoride), e.g., 300 nm from Pennwalt, polytetrafluoroethylene (PTFE), e.g., 300 nm L2 from Daikin, or melamine, e.g., 300 nm EPOSTAR-S® from Nippon Shokubai.

In a preferred embodiment, the spacer particles are large sized silica particles. Thus, preferably, the spacer particles have an average particle size greater than an average particles size of the silica and titania materials, discussed above. For example, the spacer particles in this embodiment are sol-gel silicas. Examples of such sol-gel silicas include, for example, X24, a 150 nm sol-gel silica surface treated with hexamethyldisilazane, available from Shin-Etsu Chemical Co., Ltd.

In embodiments, fluoropolymer external additives such as perfluoropolyethers, and the like are also present on the toners as external additives. These fluoropolymers can be a particulate additive, such as a spacer particle, but may also be provided in other various forms. In preferred embodiments, the fluoropolymer external additives are a wax or an oil.

In embodiments, preferred fluoropolymers include, but are not limited to, polyvinylidenefluoride polymers which are commercially available as KYNAR® from Elf Atochem. Examples of KYNAR® are KYNAR 301F which is polyvinylidenefluoride and KYNAR 201 which is copolyvinylidenefluoride tetrafluoroethylene.

In a variety of exemplary embodiments, the preferred fluoropolymers include perfluoropolyethers, for example, perfluoropolyethers comprising a segment represented by $—(C_nF_{2n}O)_x—$, or a copolymer comprised thereof, wherein n is an integral number of ranging from 1 to about 6, and x is the number of repeating units ranging from about 2 to about 1000. This segment typically has an average molecular weight of from about 100 to about 10,000.

Illustrative examples of perfluoropolyether segments can be selected from the group consisting of poly(difluoromethylene oxide), poly(tetrafluoroethylene oxide), poly(hexafluoropropylene oxide), poly(tetrafluoroethylene oxide-co-difluoromethylene oxide), poly(hexafluoropropylene oxide-co-difluoromethylene oxide), and poly(tetrafluoroethylene oxide-co-hexafluoropropylene oxide-co-difluoromethylene oxide).

Preferably, the perfluoropolyether described herein includes at least one organic group. The organic group may be connected to the end of the perfluoropolyether chain, or can be grafted to the polymer backbone thereof. Preferably, the organic group is an end group of the perfluoropolyether chain. Without limiting this disclosure, it is theorized that the organic group described herein assists the absorption of the fluorinated polymer onto the surface of the photoreceptor.

Illustrative examples of the organic group include consisting —OH, —$CH_2OH$, —$X(OCH_2CH_2)_kOH$, —$CH_2OCH_2CH(OH)CH_2OH$, —$CO_2H$, —$CO_2R$, —CON(H)R, —CON(R')R, —$SiR_n(Y)_{3-n}$, and —$(CH_2)_mSiR_n(Y)_{3-n}$, wherein X is CO or an alkylene having $C_1$ to about $C_6$, R and R' may be the same or different and each represent an alkyl group having $C_1$ to about $C_{30}$, Y is a hydrolytic group which is selected from the group consisting of hydroxyl, acetoxyl, alkoxyl having $C_1$ to about $C_6$, and the like, k is an integral number ranging from 1 to about 500, m is an integral number ranging from 1 to about 6, and n is an integral number ranging from 0 to 3. The R and R' described herein may further contain a substitute, such as a hydroxyl, an alkoxyl, a carboxyl and the like.

Specific examples of the perfluoropolyether with organic group include the perfluoropolyethers from Solvay Solexis, Inc., such as FLUOROLINK T10® having —$CH_2OCH_2CH(OH)CH_2OH$ as its organic group, FLUOROLINK E10® having —$CH_2(OCH_2CH_2)_kOH$ as its organic group, and FLUOROLINK L10® having an alkyl group, and the like. A preferred example of the perfluoropolyether is FLUOROLINK T10®. The preferred perfluoropolyethers has an average molecular weight ranging from about 50 to about 50,000, more preferably from about 100 to about 1,000.

As explained above, without limiting the present disclosure, it is theorized that fluoropolymer external additives on the toner are rubbed off in a thin layer on the silicon overcoat layer of the photoreceptor device. Such a thin layer of fluorinated polymer on the silicon overcoat layer improves deletion and life expectancy of the photoreceptor device.

The amount of the fluorinated polymer present in the toner in accordance with the present disclosure may be, for example, from about 0.01 to about 10 wt %, including from about 0.05 to about 5 wt %, and from about 0.1 to about 3 wt %, based on the total weight of the toner.

The fluoropolymer may be added to the toner particle by any appropriate conventional methods, including but not limited to tumbling the toner with the fluoropolymer additive. It is preferable that the additive be present on the toner surface. The additive may be blended onto, or fixed into, the toner surface with a low energy mixer, such as a V-cone mixer, or a high energy mixer, such as a Henschel blender, which is preferred as it provides uniform mixing of the additive and the toner.

In another embodiment, the fluoropolymer may be mixed with the carrier beads in a two-component developer, with a suitable choice of low energy mixing to disperse but not fix the additive to the carrier surface. The fluoropolymer can then subsequently be transferred from the carrier bead to the toner particle during the developer or replenisher mixing step, or may be subsequently transferred in the electrophotographic process during the process of two component developer charging in the developer housing.

In other embodiments, the fluoropolymer additive may be added or injected during the process of making the toner, such as in the extrusion step, jetting step, or classification step in jetted toner preparation. The fluoropolymer additive may also be added during the preparation of a chemical toner, including a toner prepared by the emulsion/aggregation process. The fluoropolymer additive may be added at any step of the toner process, including but not limited to, the pigment dispersion step, the toner particle formation, the toner particle coalescence, the toner particle washing, or the toner particle drying.

In embodiments, a carrier particle may optionally be mixed with the toner composition disclosed herein in a developer to be used in an electrophotographic image forming apparatus. Illustrative examples of carrier particles that can be selected for mixing with the toner composition prepared in accordance with the present disclosure include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

In a most preferred embodiment, the carrier core is comprised of a magnetite core, from about 35 to 75 μm in size. Alternate preferred carrier cores are iron ferrite cores of about 35 to 75 micron in size, or atomized steel available commercially from, for example, Hoeganaes Corporation.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like.

In a preferred embodiment, the carrier core is substantially fully coated with about 0.5% to about 5% by weight, and preferably about 1.5% by weight of a conductive polymer mixture comprised of polymethylacrylate (PMMA) and carbon black.

In another embodiment, the carrier core is partially coated with a polymethyl methacrylate (PMMA) polymer having a weight average molecular weight of 300,000 to 350,000 commercially available from Soken. The PMMA is an electropositive polymer in that the polymer that will generally impart a negative charge on the toner with which it is contacted.

The PMMA may optionally be copolymerized with any desired comonomer. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

In a another preferred embodiment herein, the polymer coating of the carrier core is comprised of PMMA, most preferably PMMA applied in dry powder form and having an average particle size of less than 1 micrometer, preferably less than 0.5 micrometers, that is applied (melted and fused) to the carrier core at higher temperatures on the order of 220° C. to 260° C. Temperatures above 260° C. may adversely degrade the PMMA. Triboelectric tunability of the carrier and developers herein is provided by the temperature at which the carrier coating is applied, higher temperatures resulting in higher tribo up to a point beyond which increasing temperature acts to degrade the polymer coating and thus lower tribo.

Toner compositions and processes for producing such toners according to the described embodiments are further illustrated by the following examples. The examples are intended to be merely further illustrative of the described embodiments.

Specific embodiments of the disclosure will now be described in detail. These examples are intended to be illustrative, and the disclosure is not limited to the materials, conditions, or process parameters set forth in these embodiments. All parts and percentages are by weight unless otherwise indicated.

EXAMPLES

A typical example of a silicon overcoat formulation use in the present disclosure may be prepared as follows Step 1. 5.8 parts of a compound of Formula (II-1) as shown below, 11 parts of a compound of Formula (III-1) as shown below, and 11 parts of methanol were mixed, and 2 parts of an ion exchange resin (AMBERLIST H15) were added thereto, followed by stirring for 2 hours.

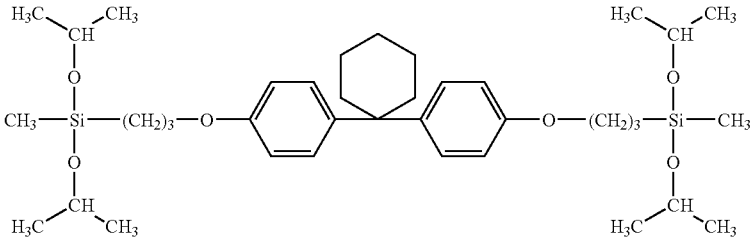

compound of Formula (II-1)

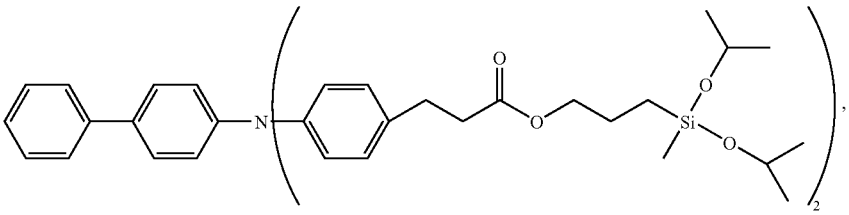

compound of Formula (III-1)

Step 2. 32 parts of butanol and 4.92 parts of distilled water were added to the mixture, followed by stirring at room temperature for 30 minutes. Then, the resulting mixture was filtered to remove the ion exchange resin.

Step 3. 0.180 parts of aluminum trisacetylacetonate ($Al(AcAc)_3$), 0.180 parts of acetylacetone (AcAc), 2 parts of a polyvinyl butyral resin (trade name: BX-L, manufactured by Sekisui Chemical Co., Ltd.), 0.0180 parts of butylated-hydroxytoluene (BHT), and 0.261 parts of a hindered phenol antioxidant (IRGANOX 1010) were added to the filtrate obtained in Step 2 and thoroughly dissolved therein for 2 hours to obtain a coating solution for a SOC layer. The coating solution thus prepared was applied onto a charge transfer layer by dip coating and dried by heating at 130° C. for one hour to form the protective layer having a film thickness of 3 μm, thereby obtaining a desired electrophotographic photoreceptor.

Typical examples of emulsion/aggregation toner particles used in the present disclosure are comprised of the following compositions:

Toner A.

Latex Composition: 76.5 wt %/23.5 wt % styrene/butyl acrylate incorporating 3 pph β-carboxyethylacrylate. The toner molecular weight, Mw, is 33,000 and the Tg is Tg=49.3° C.

Pigment: Carbon Black, 6 weight % of toner particles

Wax: 9 weight % of toner particles

Toner Particle Size: 5.8 μm

Toner B.

Latex Composition: 81.7 wt %/18.3 wt % styrene/butyl acrylate incorporating 3 pph β-carboxyethylacrylate. The toner molecular weight Mw is 37,600 and the Tg is Tg=59.6° C.

Pigment: Carbon Black, 8 weight % of toner particles

Wax: 5 weight % of toner particles

Gel: Gel latex is 50 nm in size comprised of 65 wt %/35 wt % styrene/butyl acrylate incorporating 3 pph β-carboxyethylacrylate and 1 pph divinylbenzene cross-linking agent. The gel latex has a Mw of 33510 and a Tg of 41° C., and comprises 10 weight % of toner particles.

Toner Particle Size: 5.89 μm

All toners are blended in a 10-L Henschel blender using 1.5 Kg toner particles. Additives are added in pph relative to the parent toner weight, and are 1.71% RY50 silica, 1.11% JMT200 titania, 0.74% X24 sol-gel silica, and a fluorinated polymer additive in various amounts. The toner particles and additives are blended at 3000 RPM for 15 minutes. The final blended toners are sieved using an Alpine Jet sieve apparatus and a 45 um screen.

The charge properties of the toners having the fluoropolymer additives are measured using a charge spectrograph. The toner charge (q/d) is measured as the midpoint of the toner charge distribution in the charge spectrograph trace. The charge is reported in millimeters of displacement from the zero line in a charge spectrograph using an applied transverse electric field of 100 volts per cm and a column length of 30 cm. The q/d measured in mm can be converted to a value in fC/μm by multiplying the value in mm by 0.092. To measure the charge properties, 5 wt % toner is added to carrier particles comprised of a ferrite core and conditioned overnight at 23° C. and 50% RH, and subsequently charged by mixing on a turbula mixer for 60 minutes.

As seen from Table 1, minimal impact from the addition of the fluoropolymer was generally detected for blended samples of Toner A. Sample 4 did not impact toner charge at all.

TABLE 1

Toner Charge and Torque Properties.

| TONER | Q/D (mm) | TORQUE (Nm) |
|---|---|---|
| Control (no fluoropolymers) | −9.2 | 1.05 |
| Sample 1 (0.1 wt. % FLUOROLINK T10) | −8.4 | 0.65 |
| Sample 2 (0.1 wt. % FLUOROLINK E10) | −7.3 | 0.94 |
| Sample 3 (0.1 wt. % FLUOROLINK L10) | −2.9 | 0.98 |

TABLE 1-continued

Toner Charge and Torque Properties.

| TONER | Q/D (mm) | TORQUE (Nm) |
|---|---|---|
| Sample 4 (1 wt. % KYNAR) | −9.2 | 0.80 |

The torque properties, measured in Newton·meter, of the photoreceptor are measured in the following manner. A photoreceptor was placed in a xerographic customer replaceable unit (CRU), as is used in a DC555 (manufactured by Xerox Corporation). The torque properties of the photoreceptor with the toners disclosed herein are also demonstrated in Table 1 for samples of the blended Toner A. The average of the torque was measured at six seconds of rotation of the photoreceptor devices.

The image quality of the toners containing the fluoropolymer additive was evaluated by a print test using a printing machine equipped with the electrophotographic photoreceptor described herein in a humid environment (for example, 28° C. and 85% relative humidity). No adverse impact was observed on initial image quality and the image quality after 10,000 prints.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An electrophotographic image forming system comprising:

a toner; and an electrophotographic image forming apparatus comprising a photoreceptor, a latent image forming device for forming an electrostatic latent image on a surface of the photoreceptor, a developing device for developing the latent image with the toner, and a transfer device for transferring the toner image to an image receiving member, wherein the photoreceptor includes at least a silicon overcoat layer, and wherein the toner comprises toner particles of at least one binder, at least one colorant, and external additives, wherein the external additives include at least one fluoropolymer, and wherein the fluoropolymer is a perfluoropolyether wax comprising a segment represented by $—(C_nF_{2n}O)_x—$,or a copolymer comprised thereof, wherein n is an integral number ranging from 1 to about 6, and x is the number of repeating units ranging from about 2 to about 1000.

2. The electrophotographic image forming system according to claim 1, wherein the fluoropolymer is about 0.01% to about 5.0% by weight of the toner particles.

3. The electrophotographic image forming system according to claim 1, wherein the perfluoropolyether further comprises an organic group selected from the group consisting of —OH, $—CH_2OH$, $—X(OCH_2CH_2)_kOH$, $—CH_2OCH_2CH(OH)CH_2OH$, $—CO_2H$, $—CO_2R$, —CON(H)R, —CON(R')R, $—SiR_n(Y)_{3-n}$, and $—(CH_2)_mSiR_n(Y)_{3-n}$, wherein X is CO or an alkylene having $C_1$ to about $C_6$, R and R' are the same or different and each represent an alkyl group having $C_1$ to about $C_{30}$, Y is a hydrolytic group which is selected from the group consisting of hydroxyl, acetoxyl, alkoxyl having $C_1$ to about $C_6$, k is an integral number ranging from 1 to about 500, m is an integral number ranging from 1 to about 6, and n is an integral number ranging from 0 to 3.

4. The electrophotographic image forming system according to claim 1, wherein the organic group is an end group of the perfluoropolyether.

5. The electrophotographic image forming system according to claim 1, wherein the perfluoropolyether includes a segment selected from the group consisting of poly(difluoromethylene oxide), poly(tetrafluoroethylene oxide), poly(hexafluoropropylene oxide), poly(tetrafluoroethylene oxide-co-difluoromethylene oxide), poly(hexafluoropropylene oxide-co-difluoromethylene oxide), and poly(tetrafluoroethylene oxide-co-hexafluoropropylene oxide-co-difluoromethylene oxide).

6. The electrophotographic image forming system according to claim 1, wherein the perfluoropolyether has an average molecular weight ranging from about 50 to about 50,000.

7. The electrophotographic image forming system according to claim 1, wherein the organic group is connected to the end of the perfluoropolyether chain, or is grafted to the polymer backbone thereof.

8. The electrophotographic image forming system according to claim 1, wherein the external additives further include at least one of silica ($SiO_2$) or titania ($TiO_2$).

9. The electrophotographic image forming system according to claim 1, wherein the toner particle is prepared by emulsion aggregation or suspension polymerization.

10. The electrophotographic image forming system according to claim 1, wherein the toner is an emulsion aggregation toner including a styrene-acrylate polymer or a polyester as the at least one binder.

11. An electrophotographic image forming method comprising developing an electrostatic image on a surface of a photoreceptor with a toner to develop a toner image, transferring the toner image to an image receiving member to form a transferred image, and fixing the transferred image to the image receiving member, wherein the photoreceptor includes at least a silicon overcoat layer, and wherein the toner comprises toner particles of at least one binder, at least one colorant, and external additives, wherein the external additives include at least one fluoropolymer, and wherein the fluoropolymer is a perfluoropolyether wax comprising a segment represented by $—(C_nF_{2n}O)_x—$, or a copolymer comprised thereof, wherein n is an integral number ranging from 1 to about 6, and x is the number of repeating units ranging from about 2 to about 1000.

12. The electrophotographic image forming method according to claim 11, wherein the fluoropolymer is about 0.01% to about 5.0% by weight of the toner particles.

13. The electrophotographic image forming method according to claim 11, wherein the perfluoropolyether further comprises an organic group selected from the group consisting of —OH, $—CH_2OH$, $—X(OCH_2CH_2)_kOH$, $—CH_2OCH_2CH(OH)CH_2OH$, $—CO_2H$, $—CO_2R$, —CON(H)R, —CON(R')R, $—SiR_n(Y)_{3-n}$, and $—(CH_2)_mSiR_n(Y)_{3-n}$, wherein X is CO or an alkylene having $C_1$ to about $C_6$, R and R' are the same or different and each represent an alkyl group having $C_1$ to about $C_{30}$, Y is a hydrolytic group which is selected from the group consisting of hydroxyl, acetoxyl, alkoxyl having $C_1$ to about $C_6$, k is an integral number ranging from 1 to about 500, m is an integral number ranging from 1 to about 6, and n is an integral number ranging from 0 to 3.

14. The electrophotographic image forming method according to claim 11, wherein the organic group is an end group of the perfluoropolyether.

15. The electrophotographic image forming method according to claim 11, wherein the perfluoropolyether includes a segment selected from the group consisting of poly(difluoromethylene oxide), poly(tetrafluoroethylene oxide), poly(hexafluoropropylene oxide), poly(tetrafluoroethylene oxide-co-difluoromethylene oxide), poly(hexafluoropropylene oxide-co-difluoromethylene oxide), and poly(tetrafluoroethylene oxide-co-hexafluoropropylene oxide-co-difluoromethylene oxide).

16. The electrophotographic image forming method according to claim 11, wherein the perfluoropolyether has an average molecular weight ranging from about 50 to about 50,000.

17. The electrophotographic image forming method according to claim 11, wherein the organic group is connected to the end of the perfluoropolyether chain, or is grafted to the polymer backbone thereof.

18. The electrophotographic image forming method according to claim 11, wherein the external additives further include at least one of silica ($SiO_2$) or titania ($TiO_2$).

19. The electrophotographic image forming method according to claim 11, wherein the toner particle is prepared by emulsion aggregation or suspension polymerization.

20. The electrophotographic image forming method according to claim 11, wherein the toner is an emulsion aggregation toner including a styrene-acrylate polymer or a polyester as the at least one binder.

* * * * *